United States Patent [19]

Johnson

[11] 4,089,170

[45] May 16, 1978

[54] POWER CONSERVATION MEANS FOR VARIABLE DISPLACEMENT PUMP FLUID SUPPLY SYSTEM

[75] Inventor: Howard L. Johnson, Joliet, Ill.

[73] Assignee: Caterpillar Tractor Co., Peoria, Ill.

[21] Appl. No.: 795,032

[22] Filed: May 9, 1977

[51] Int. Cl.[2] ..... F16H 39/46

[52] U.S. Cl. ..... 60/445; 60/452; 417/212

[58] Field of Search ..... 60/445, 452, 459, 494; 417/212, 213

[56] References Cited

U.S. PATENT DOCUMENTS

| | | | |
|---|---|---|---|
| 3,664,127 | 5/1972 | Praddaude | 60/459 X |
| 3,695,783 | 10/1972 | Soyland et al. | 417/216 |
| 3,864,063 | 2/1975 | Martin | 417/222 |
| 3,889,340 | 6/1975 | Dixon | 60/452 X |

*Primary Examiner*—Edgar W. Geoghegan
*Attorney, Agent, or Firm*—Phillips, Moore, Weissenberger, Lempio & Majestic

[57] ABSTRACT

Pressurized fluid is supplied to fluid-driven mechanisms by a variable displacement supply pump through a check valve and a flow control valve. A compensator receiving a pressure feedback signal from the control valve side of the check valve increases pump displacement in response to a pressure signal drop and decreases pump displacement in response to a rise in the signal pressure to compensate for variations in demand. Part of the supply pump output is used to drive a small fluid motor which turns a small pressure signal-amplifying pump connected in parallel with the check valve. The check valve opens to transmit the variable displacement pump output to the driven mechanisms when the control valve is opened. When the flow control valve is closed the check valve also closes enabling the fluid motor and pressure signal-amplifying pump to maintain the feedback signal to the compensator at a high pressure while the actual output pressure of the supply pump drops owing to the reduced displacement caused by the high feedback signal. The resulting internal pressure reduction in the supply pump during standby periods greatly reduces leakage which translates into power and fuel or energy savings.

10 Claims, 2 Drawing Figures

POWER CONSERVATION MEANS FOR VARIABLE DISPLACEMENT PUMP FLUID SUPPLY SYSTEM

BACKGROUND OF THE INVENTION

This invention relates to systems for supplying pressurized fluid to fluid-operated mechanisms. More particularly, the invention relates to fluid supply systems having a variable displacement pump with a compensator that stabilizes the pump output pressure by varying pump displacement in response to a pressure feedback signal from the output.

Variable displacement pump fluid supply systems with a pressure compensator are extensively used to provide driving fluid for hydraulic cylinders and also with other forms of fluid circuit. Basic elements of such a system include a variable displacement pump driven by a motor and drawing fluid from a reservoir. The pump delivers fluid under pressure to any of various mechanisms through a flow control valve which may be closed to stop operation of the driven mechanisms and which may be open to actuate the mechanisms. The compensator responds to a pressure signal, taken from the discharge side of the pump, by increasing pump displacement when discharge pressure drops and by decreasing displacement when discharge pressure rises above a predetermined level and thus tends to stabilize output pressure when changes in the demand for fluid occur.

It is an inherent characteristic of a variable displacement pump that some back leakage of fluid occurs past the pump pistons or other internal mechanisms. In other words, some fluid finds its way back to the supply reservoir through various leakage paths rather than being transmitted to the pump outlet. Steps may be taken to minimize such leakage but as a practical matter some amount of leakage will still occur at least in most forms of pump.

One of the consequences of such leakage is that the pump must have larger pumping capacity than would otherwise be the case. A less obvious but equally serious consequence of leakage is power wastage. Some form of motor, engine or the like is used to drive the pump and the driving motor must consume fuel or otherwise draw upon some energy source. To the extent that the driving motor or the like must deliver power to replace fluid lost through leakage paths, a wastage of power is occurring. Fuel or other energy supplies are uselessly consumed.

Leakage flow within the pump and the consequent power wastage are proportional to the fluid pressure within the pump. Thus the problem of power wastage becomes increasingly severe in higher pressure systems.

SUMMARY OF THE INVENTION

The present invention is directed to overcoming one or more of the problems as set forth above.

According to the present invention, a fluid supply system of the kind having a pressure-compensated variable displacement pump is provided with means for reducing power wastage during the standby periods when the system is not delivering fluid but is operating in order to be ready to deliver fluid on demand. A relatively small proportion of the supply pump output is used to operate means which transmits an amplified feedback pressure signal to the compensator during the standby periods when the flow control valve is closed.

Consequently, supply pump displacement is decreased and the internal pressure in the pump is substantially lowered at such times. The consequent reduction of internal leakage within the pump, from the lowered internal pressure, effects a substantial reduction of power wastage during the standby periods.

In a preferred form of the invention, a check valve is provided between the variable displacement pump outlet and the flow control valve through which the pump supplies pressurized fluid. A small fluid motor is driven by fluid obtained from between the supply pump outlet and the check valve and in turn drives a small pressure signal-amplifier pump connected in parallel with the check valve.

The pressure signal for the compensator is taken from between the check valve and the flow control valve. Consequently, when the flow control valve is closed the amplifier pump causes a high signal pressure to continue to be delivered to the compensator while the actual output pressure of the pump drops due to the reduced displacement, the fluid flow through the fluid motor and internal leakage. Owing to the reduced internal pressure within the variable displacement pump during the standby periods, leakage and power consumption is also greatly reduced at such times.

Upon opening of the flow control valve to actuate the mechanisms which the system supplies with fluid, the check valve opens to transmit the discharge of the variable displacement pump to the flow control valve. This reduces the pressure compensator signal causing pump displacement to increase to meet the demand for fluid.

DESCRIPTION OF A PREFERRED EMBODIMENT

Figure 1:
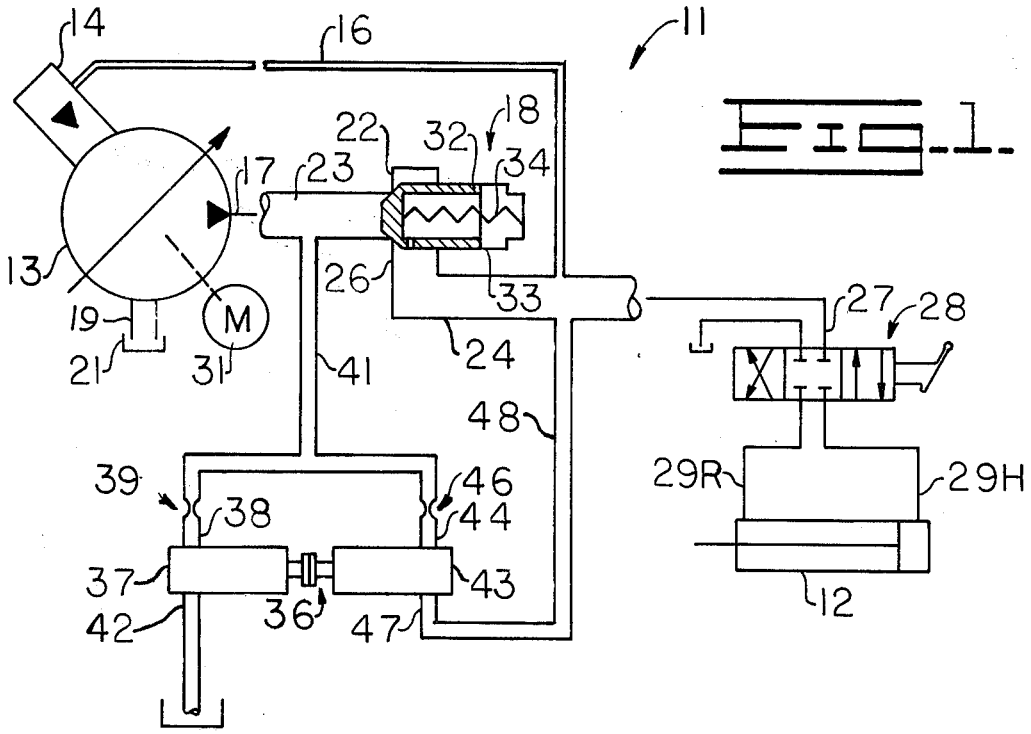
FIG. 1 is a schematic view of a pressurized fluid supply system in accordance with the invention illustrating conditions which obtain when the flow control valve of the system is closed and the system is in standby condition.

Referring now to FIG. 1, there is shown a pressurized fluid supply system 11 for delivering fluid under pressure to a fluid-driven mechanism which in this particular example is a fluid cylinder 12. The supply system 11 may also provide pressurized fluid to a plurality of cylinders 12 or to any of various other forms of fluid-operated mechanisms known to the art.

The pressurized fluid supply system 11 has a pump 13 of the variable displacement form which is provided with a compensator 14 which functions to increase the pump displacement in response to a decrease of pressure in a pressure signal line 16 and to decrease pump displacement in response to a rise of pressure in the signal line 16. The variable displacement pump 13 and compensator 14 may be of the known forms. If the pressure from the outlet 17 of the pump is fed back through signal line 16, the compensator tends to maintain a constant predetermined pressure at the pump outlet by changing pump displacement as necessary to accommodate to variations of fluid demand. In the present system, the pressure signal line 16 is not communicated directly with the pump outlet 17 in the usual manner but is instead connected indirectly with the outlet 17 through a check valve 18 for reasons which will hereinafter be discussed in more detail.

Variable displacement pump 13 has an inlet 19 drawing fluid, such as oil for example, from a suitable supply reservoir tank 21. The pump outlet 17 is communicated with the inlet 22 of check valve 18 through a first flow line 23 and a second flow line 24 communicates the outlet 26 of the check valve wih the inlet 27 of a flow control valve 28.

The flow control valve 28 may take various forms depending on the type of fluid-operated mechanism which the supply system 11 services. In this example, where the fluid-operated mechanism is a single fluid cylinder 12, flow control valve 28 may be of the three-position form. Control valve 28 has a closed position at which flow line 24 is closed and at which both lines 29R and 29H to the rod end and head end respectively of the fluid cylinder 12 are also closed, thereby immobilizing the cylinder. Flow control valve 28 in this example has a second position at which pressurized fluid from flow line 24 is transmitted to line 29R while line 29H is vented to the reservoir, thereby causing the cylinder to contract, and has a third position at which line 29H receives fluid while line 29R is vented to the reservoir in order to cause the cylinder to extend.

Pressure signal line 16 which transmits the pump discharge pressure back to compensator 14 is communicated with the second flow line 24.

If the presence of the check valve 18 in the flow path from the pump 13 to the flow control valve 28 is temporarily disregarded, then it may be seen that the fluid supply system 11 as described to this point would be essentially of conventional form and would function in the conventional manner. With flow control valve 28 in the closed position, a relatively high pressure signal would be fed back through pressure signal line 16 to the compensator 14 which would respond by reducing the displacement of supply pump 13 to limit the pressure in flow lines 23 and 24 and within the pump itself to a predetermined maximum which is established by the compensator. Under this condition, the compensator would usually not reduce the pump displacement completely to zero. There is usually a slight amount of leakage through a flow control valve 28, although it is nominally in the closed condition, and there is also usually a back leakage through the pump 13 itself. Thus, with the control valve closed, a compensator in a conventional system fixes the pump displacement at a low level which just compensates for leakage in order to maintain the pressure at the discharge side of the pump at a predetermined maximum level.

If, in the conventional supply system, the control valve is then shifted to one of the open positions, the release of fluid through the flow control valve causes a lowering of pressure at the pump outlet. The pressure decrease is transmitted back to the compensator which then responds by increasing pump displacement in order to meet the increased demand for fluid.

In the foregoing discussion of the operation of a conventional system, it has been pointed out that some leakage of fluid occurs at the flow control valve and within the pump itself during the periods when the flow control valve is closed and the system is essentially in a standby condition. The pump 13 must be driven by some form of motor 31 which in turn must draw upon some source of energy such as by consuming fuel, electrical energy or the like. To the extent that leakage occurs while the system is in the standby condition, the motor 31 is forced to do extra work to maintain the standby pressure at the pump outlet 17. Thus such leakage consumes power and causes a wastage of fuel or other energy supplies.

The present invention greatly reduces this power wastage during periods when the system is in the standby position. In part, this is accomplished by blocking the flow path from the pump outlet 17 to the flow control valve 28 during the standby periods, by means such as the check valve 18. As the check valve is situated between the supply pump outlet 17 and pressure signal line 16, it is then possible to maintain a high pressure in the signal line while the actual pressure at the pump outlet and within the pump itself is reduced. Since the pressure within the supply pump 13 is reduced in this manner during the standby periods, back leakage within the pump is also reduced. This results in a sizable reduction in the power which the drive motor 31 must deliver during the standby periods.

Considering now suitable fluid circuit means for accomplishing the power-saving as discussed above, the check valve 18 may be of the form having a valve element 32 movable within a housing 33 and urged by a spring 34 toward a closed position at which the valve element seats at inlet 22 to block fluid flow from flow line 24 to flow line 23. When the pressure in flow line 23 exceeds that in flow line 24 as occurs when control valve 28 is opened, the valve element 32 is forced away from the closed position to allow fluid to flow from pump outlet 17 to the flow control valve 28. During the standby periods when flow control valve 28 is closed, means 36 function to raise the pressure in flow line 24 above that in flow line 23 and the check valve 18 closes at such times to isolate the two flow lines from each other.

Means 36 may include a small fluid motor 37 having a driving fluid inlet 38 communicated with flow line 23 through a first flow orifice 39 and conduit 41. The discharge outlet 42 of fluid motor 37 returns fluid to the reservoir 21. Motor 37 mechanically drives a small pressure signal-amplifying pump 43. Pressure signal amplifying pump 43 has a fluid inlet 44 communicated with flow line 23 through a second flow orifice 46 and conduit 41 while the outlet 47 of the signal-amplifying pump is communicated with flow line 24 through another conduit 48.

Thus the fluid motor 37 is driven by a small flow of pressurized fluid diverted from the supply pump outlet flow line 23 with the magnitude of this diverted flow being established by sizing of the first orifice 39. This causes the signal-amplifying pump 43 to withdraw another small flow of fluid from flow line 23 as determined by the sizing of the second orifice 46. The output flow from amplifying pump 43 is delivered to flow line 24 thereby raising the pressure in flow line 24 relative to the pressure line flow line 23 when check valve 18 is closed and the system is in the standby condition.

In operation, during the standby periods when the flow control valve 28 is closed, the flow of fluid from flow line 23 to motor 37 causes the motor to drive amplifying pump 43 which then establishes a pressure in flow line 24 higher than that at flow line 23. The check valve 18 prevents this higher pressure from being fed back to flow line 23. At the same time, the pressure drops substantially in flow line 23 due in part to internal back leakage through the pump 13 and in part to the small draining of fluid through motor 37. Unlike what occurs in a conventional system, compensator 14 does not respond to this pressure drop by increasing pump displacement to maintain the normal high discharge pressure in flow line 23 since the compensator is receiving the elevated pressure of flow line 24 through pressure signal line 16. In other words, at this time it appears to the compensator 14 that the output pressure of the supply pump 13 is at the normal high operating level when in actual fact such output pressure has been substantially lowered.

Since the internal leakage flow within the supply pump 13 is a function of the internal pressure within the pump, which internal pressure has been substantially lowered, leakage is reduced and the desired power savings are realized.

Figure 2:
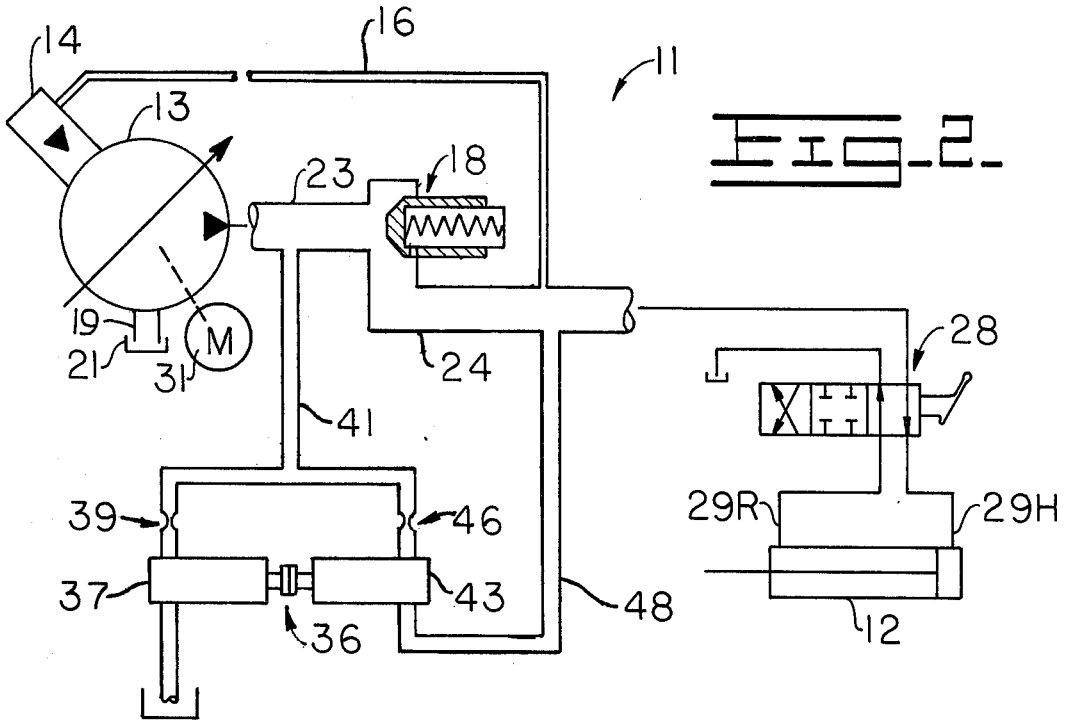
FIG. 2 is a second schematic view of the system of FIG. 1 showing conditions which exist when the flow control valve is opened and the system is supplying fluid to fluid-driven mechanisms.

The output pressure of the supply pump 13 in flow line 23 quickly returns towards normal high operating level upon the opening of the flow control valve 28. As depicted in FIG. 2, the release of fluid through the flow control valve 28 at such time causes a pronounced pressure drop to occur in flow line 24. This pressure drop is fed back through signal line 16 to the compensator 14 which then acts to increase pump displacement. Check valve 18 also opens in response to the pressure drop and to the increased output of the variable displacement pump. Thus high pressure fluid is supplied to the cylinder 12 or other fluid-operated mechanism as needed. Fluid motor 37 and signal-amplifying pump 43 continue to operate at this time but are no longer able to raise the pressure in flow line 24 above that in flow line 23 as check valve 18 is now open. Owing to the second flow orifice 46 at the inlet side of the signal-amplifying pump 43, the output flow from amplifying pump 43 is very small and does not significantly affect the pressure signal to the compensator 14 during this stage of operation. Thus, the pressure drop produced by opening of the flow control valve 28 overrides the action of the signal-amplifying pump 43 which can only deliver a very small flow in comparison with the rate at which fluid is not being withdrawn from flow line 24 through the flow control valve 28.

Upon reclosing of control valve 28, the system reverts to the standby mode of operation described above. Since fluid is no longer being withdrawn from flow line 24, aside from the minute leakage through the closed control valve 28, the small high-pressure output flow from pump 43 is again able to close check valve 18 and to cause compensator 14 to decrease supply pump displacement thereby re-establishing the previously described standby mode of operation.

At first consideration it might seem that the objective of reducing power loss would not be served by means 36 which establishes still another flow path, conduit 41, through which fluid may be released to the reservoir during the standby periods. However, the reduction of leakage within supply pump 13, from the lowered internal pressure, exceeds the small flow required to operate fluid motor 37 of means 36. Thus the small fluid loss required to operate the fluid motor 37 can be accepted while still realizing a substantial power saving.

To consider a specific example, a typical variable displacement pump 13 operated to provide 3000 psi ($20.68 \times 10^6$Pascal) standby pressure at the outlet 17 may lose about 4 gallons (15l) per minute of oil from internal leakage. This requires a 7.2 horsepower (5370 watts) input during the standby condition in order to maintain the 3000 psi at the pump output in the presence of such leakage. If, by means of the present invention, the pressure in flow line 23 is reduced to 1500 psi ($10.34 \times 10^6$ Pascal) during the standby periods then leakage is also reduced by one-half but the power input required to maintain the 1500 psi pressure in flow conduit 23 is only 1.8 horsepower (1340 watts) or approximately one-fourth of the previous value. This power saving greatly exceeds the new power loss arising from the presence of a drainage path through fluid motor 37.

To minimize power loss arising from the means 36 itself, the second flow orifice 46 may be sized to provide a flow through amplifying pump 43 just large enough to replace fluid lost by leakage through the closed flow control valve 28 and through such other leakage points as may be communicated with flow line 24. The first flow orifice 39 may then be sized just large enough to enable fluid motor 37 to drive the amplifying pump 43.

The extent to which the invention reduces the pressure in flow line 23 relative to flow line 24 during the standby periods is dependent upon the ratio of the displacements of fluid motor 37 and signal amplifying pump 43. More specifically, the relationship is: $P_1 = P_2/K$ where $P_1$ = standby pressure in flow line 23, $P_2$ = standby pressure in flow line 24, and K = motor 37 displacement divided by signal-amplifying pump 43 displacement plus one. Thus the degree of pressure reduction in flow line 23 during the standby period may be fixed at a desired value by sizing of components in accordance with the foregoing relationship. From the foregoing relationship it may also be seen that the specific example of the invention described above, which maintained the pressure in flow line 23 at one-half of the pressure in flow line 24, during the standby periods, is a case where the displacements of motor 37 and pump 43 are equal.

While the invention realizes substantial power savings during the standby periods when control valve 28 is closed, this result is not realized while control valve 28 is open and the system is delivering pressurized fluid to cylinder 12 or other fluid-operated mechanisms. During those times, the small loss of fluid through fluid motor 37 is a power loss itself. Thus, in the form herein described, the invention is primarily of value in systems which remain in the standby condition for a sizable proportion of the total operating time.

While the invention has been described with respect to a specific embodiment, it will be apparent that numerous modifications are possible and it is not intended to limit the invention except as defined in the following claims.

The embodiments of the invention in which an exclusive property or privilege is claimed are defined as follows:

1. A pressurized fluid supply system for fluid-operated mechanism comprising:

a variable displacement pump having an inlet connected to a source of fluid and having a pressurized fluid outlet, said variable displacement pump further having a compensator which responds to a signal pressure by decreasing pump displacement when the signal pressure rises and by increasing pump displacement when the signal pressure drops, a flow control valve having an open position for admitting pressurized fluid to said fluid-operated mechanism, and having a closed position, a check valve having an inlet and an outlet, first flow line means communicating said variable displacement pump outlet with said inlet of said check valve, and second flow line means communicating said outlet of said check valve with said flow control valve, signal line means for transmitting fluid pressure from said second flow line means to said compensator, and means for raising the pressure in said second flow line means above the pressure in said first flow line means when said flow control valve is closed.

2. The combination of claim 1 wherein said pressure raising means comprises a pressure signal-amplifying pump having an inlet communicated with said first flow line means and having an outlet communicated with said second flow line means, and means for driving said amplifying pump.

3. The combination of claim 2 wherein said means for driving said amplifying pump is a fluid motor having a driving fluid inlet communicated with said first flow line means.

4. The combination of claim 3 wherein said pressure signal-amplifying pump delivers fluid to said second flow line means at a rate at least equal to the rate of leakage through said flow control valve when said flow control valve is in the closed condition.

5. The combination defined in claim 3 wherein said driving fluid inlet of said fluid motor is communicated with said first flow line means through a first flow orifice.

6. The combination defined in claim 5 wherein said inlet of said pressure signal-amplifying pump is communicated with said first flow line means through a second flow orifice.

7. The combination defined in claim 6 wherein said second flow orifice restricts flow through said pressure signal-amplifying pump to a flow rate substantially smaller than the rate of flow through said flow control valve when said control valve is in the open condition.

8. The combination defined in claim 6 wherein said fluid motor and said pressure signal-amplifying pump and said first and second flow orifices are sized to enable said pressure signal-amplifying pump to maintain the pressure in said second flow line means at a value determined by the relationship: $P_1 = P_2/K$, where $P_1 =$ the pressure in said first flow line means, $P_2 =$ the pressure in said second flow line means and $K =$ one plus the displacement of said fluid motor divided by the displacement of said signal-amplifying pump.

9. The combination defined in claim 1 wherein said variable displacement pump draws said fluid from a reservoir tank and wherein said means for raising the pressure in said second flow line means comprises a pressure signal-amplifying pump having an inlet communicated with said first flow line means and having an outlet communicated with said second flow line means, and a fluid motor coupled to said amplifying pump to drive said amplifying pump, said fluid motor having a driving fluid inlet communicated with said first flow line means and a driving fluid outlet communicated with said reservoir tank.

10. The combination defined in claim 9 wherein said control valve has an open position at which fluid is released from said second flow line means at a greater rate than fluid is supplied to said second flow line means by said amplifying pump.

* * * * *